US011707135B2

(12) United States Patent
George, II et al.

(10) Patent No.: US 11,707,135 B2
(45) **Date of Patent: *Jul. 25, 2023**

(54) FRAMELESS FURNITURE ASSEMBLY

(71) Applicants: Daniel C. George, II, Grand Rapids, MI (US); Matthew Jung, Ada, MI (US)

(72) Inventors: Daniel C. George, II, Grand Rapids, MI (US); Matthew Jung, Ada, MI (US)

(73) Assignee: Comfort Research, LLC, Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/114,952

(22) Filed: Dec. 8, 2020

(65) Prior Publication Data

US 2021/0227978 A1 Jul. 29, 2021

Related U.S. Application Data

(63) Continuation of application No. 16/861,173, filed on Apr. 28, 2020, now abandoned, which is a continuation of application No. 15/683,363, filed on Aug. 22, 2017, now Pat. No. 10,631,644, which is a continuation of application No. 14/516,108, filed on Oct. 16, 2014, now Pat. No. 9,737,146, which is a continuation-in-part of application No. 13/954,399, filed on Jul. 30, 2013, now abandoned.

(60) Provisional application No. 61/677,325, filed on Jul. 30, 2012.

(51) Int. Cl.
*A47C 3/16* (2006.01)
*A47C 27/08* (2006.01)

(52) U.S. Cl.
CPC ..... *A47C 3/16* (2013.01); *A47C 27/087* (2013.01)

(58) Field of Classification Search
CPC ..... A47C 27/086; A47C 4/54; A47C 27/10; A47C 3/16; A61G 7/05753
USPC ..... 297/452.41, 452.17
See application file for complete search history.

(56) References Cited

U.S. PATENT DOCUMENTS

| | | | | |
|---|---|---|---|---|
| 2,281,629 | A | 5/1942 | Snow | |
| 2,298,218 | A * | 10/1942 | Madson | A47C 27/14 5/638 |
| D173,389 | S | 11/1954 | Sherman | |
| D227,835 | S | 7/1973 | Kublemann | |
| D228,595 | S | 10/1973 | Korch | |
| 3,899,210 | A | 8/1975 | Samhammer et al. | |
| D239,795 | S | 5/1976 | Barnard | |
| 3,965,506 | A | 6/1976 | Marks | |
| D242,964 | S | 1/1977 | Haynes, Sr. | |
| D243,045 | S | 1/1977 | Haynes, Sr. | |
| D243,047 | S | 1/1977 | Haynes, Sr. | |
| 4,011,611 | A | 3/1977 | Lederman | |
| D244,071 | S | 4/1977 | Haynes, Sr. | |

(Continued)

*Primary Examiner* — Sarah B McPartlin
(74) *Attorney, Agent, or Firm* — Price Heneveld LLP

(57) ABSTRACT

A frameless furniture assembly adapted to be converted between an unfilled configuration and a filled configuration including: an outer liner having an inner surface and an outer surface; a plurality of pieces of fill material, wherein the fill material is retained within the outer liner; and at least one configuration support member associated with the inner surface of the outer liner. The frameless furniture assembly is preferably adapted to support a human in a seated position.

4 Claims, 11 Drawing Sheets

(56) References Cited

U.S. PATENT DOCUMENTS

| | | | | |
|---|---|---|---|---|
| 4,027,888 | A * | 6/1977 | Wilcox | A47C 3/16 297/284.1 |
| D246,492 | S | 11/1977 | Roset | |
| D248,520 | S | 7/1978 | Haynes, Sr. | |
| D248,699 | S | 8/1978 | Haynes, Sr. | |
| D248,701 | S | 8/1978 | Haynes, Sr. | |
| D249,104 | S | 8/1978 | Haynes, Sr. | |
| D252,782 | S | 9/1979 | Roset | |
| 4,171,549 | A | 10/1979 | Morrell et al. | |
| 4,213,213 | A | 7/1980 | Burnett | |
| D257,087 | S | 9/1980 | Roset | |
| D262,676 | S | 1/1982 | Roset | |
| D265,027 | S | 6/1982 | Meyers | |
| D280,365 | S | 9/1985 | Hopfer | |
| 4,564,240 | A | 1/1986 | Thieme | |
| D287,551 | S | 1/1987 | Lewis | |
| 4,662,852 | A | 5/1987 | Schneider et al. | |
| 4,964,600 | A | 10/1990 | Lee | |
| 5,004,296 | A | 4/1991 | Ziegenfuss, Jr. | |
| 5,213,394 | A | 5/1993 | Tattrie | |
| D395,759 | S | 7/1998 | Smith | |
| D399,350 | S | 10/1998 | Hudson et al. | |
| 6,045,178 | A | 4/2000 | Miller | |
| D431,914 | S | 10/2000 | Lewis | |
| 6,141,807 | A | 11/2000 | Tapper | |
| 6,209,962 | B1 * | 4/2001 | Sobel | A47C 3/16 297/452.17 |
| 6,279,184 | B1 | 8/2001 | George, II | |
| 6,334,227 | B1 * | 1/2002 | Larger | A47C 4/54 5/655.4 |
| 6,532,613 | B2 * | 3/2003 | Berry, IV | A47C 3/16 5/654 |
| 6,611,980 | B2 | 9/2003 | Wempe | |
| 6,725,482 | B2 | 4/2004 | George, II | |
| 6,732,391 | B2 | 5/2004 | George, II | |
| 6,899,387 | B2 | 5/2005 | Ariizumi | |
| 6,952,906 | B2 | 10/2005 | Nelson | |
| 6,997,509 | B2 | 2/2006 | Kain | |
| 7,225,486 | B2 | 6/2007 | Jackson, III | |
| 7,273,251 | B2 | 9/2007 | Real et al. | |
| D577,158 | S | 9/2008 | Song | |
| D596,414 | S | 7/2009 | Natuzzi | |
| D596,862 | S | 7/2009 | Paulin | |
| 7,571,965 | B1 | 8/2009 | Perry | |
| D600,029 | S | 9/2009 | Paulin | |
| 7,676,871 | B1 | 3/2010 | Leach | |
| 7,735,931 | B1 | 6/2010 | Weiner et al. | |
| D628,400 | S | 12/2010 | Duchaufour Lawrance | |
| D628,404 | S | 12/2010 | Duchaufour Lawrance | |
| D635,375 | S | 4/2011 | Duchaufour Lawrance | |
| 8,336,964 | B2 | 12/2012 | Cho | |
| 9,737,146 | B2 | 8/2017 | George, II et al. | |
| 10,631,644 | B2 | 4/2020 | George, II et al. | |
| 2003/0066268 | A1 | 4/2003 | George, II | |
| 2003/0075957 | A1 | 4/2003 | Kain | |
| 2003/0151295 | A1 * | 8/2003 | Nelson | A47C 3/16 297/452.17 |
| 2005/0242643 | A1 | 11/2005 | Pratt et al. | |
| 2006/0284459 | A1 | 12/2006 | Real et al. | |
| 2007/0257530 | A1 | 11/2007 | Florez et al. | |
| 2008/0033327 | A1 | 2/2008 | Evans et al. | |

* cited by examiner

FRAMELESS FURNITURE ASSEMBLY

CROSS-REFERENCE TO RELATED APPLICATIONS

This application is a continuation of U.S. patent application Ser. No. 16/861,173, filed Apr. 28, 2020, entitled "Frameless Furniture Assembly," which is a continuation of U.S. patent application Ser. No. 15/683,363, filed Aug. 22, 2017, entitled "Frameless Furniture Assembly," now U.S. Pat. No. 10,631,644, which is a continuation of U.S. patent application Ser. No. 14/516,108, filed Oct. 16, 2014, entitled "Frameless Furniture Assembly," now U.S. Pat. No. 9,737,146, which is a continuation-in-part of U.S. patent application Ser. No. 13/954,399, filed Jul. 30, 2013, entitled "Chambered Frameless Furniture," which claims the benefit of U.S. Provisional Patent Application Ser. No. 61/677,325, filed Jul. 30, 2012, entitled "Chambered Frameless Furniture," which are hereby incorporated herein by reference in their entirety, including all references cited therein.

BACKGROUND OF THE INVENTION

1. Field of the Invention

The present invention relates in general to frameless furniture and, more particularly, to a frameless furniture assembly that comprises an outer liner having an inner surface associated with one or more configuration support members to, in turn, maintain a predetermined frameless furniture assembly configuration that resembles a framed furniture assembly.

2. Background Art

Various configurations of chairs and other articles of furniture have been known in the art for years and are the subject of a plurality of patents and publications, including: U.S. Pat. No. 7,676,871 entitled "Pillow Assembly with Adjustable Girth and Elastic Center Panel," U.S. Pat. No. 7,225,486 entitled "Therapeutic Seat Cushion," U.S. Pat. No. 6,952,906 entitled "Packaged Furniture Assembly and Method Thereof for Compressible Furniture," U.S. Pat. No. 6,899,387 entitled "Cushion," U.S. Pat. No. 6,725,482 entitled "Frameless Chair," U.S. Pat. No. 6,279,184 entitled "Frameless Chair," U.S. Pat. No. 6,611,980 entitled "Molded Cushion and Method of Making the Same," U.S. Pat. No. 6,141,807 entitled "Adjustable Height Pillow and Related Furniture," U.S. Pat. No. 3,965,506 entitled "Furniture Construction," and United States Patent Application Publication Number 2003/0066268 entitled "Process for Packaging a Polyurethane Foam Filled Article of Furniture"—all of which are hereby incorporated herein by reference in their entirety including the references cited therein.

U.S. Pat. No. 7,676,871 appears to disclose a pillow assembly with an elastic center panel and an adjustable girth. The pillow assembly comprises a C-shaped or ring-shaped pillow body and a pillow cover. The cover defines a continuous, generally tubular, ring-shaped enclosure sized to receive the pillow body. The pillow body defines a well, and the cover preferably includes a center panel that spans the well and forms a seat area. A cinch assembly on the front of the pillow cover allows the overall girth of the pillow assembly to be adjusted.

U.S. Pat. No. 7,225,486 appears to disclose a therapeutic seat cushion which supports a person remaining in a sitting position for a prolonged period of time, wherein the cushion is a generally rectangular body having a hollow interior with a plurality of generally radially extending partitions extending across the interior of the body, dividing it into a plurality of individual chambers spaced sequentially around the body. Apparatus is connected with the chambers to sequentially expand and contract them in an alternating pattern so that some of the chambers are expanded to contact and support the person while other chambers are contracted to relieve the pressure exerted against the person by the other chambers, whereby the formation of pressure sores and other harmful effects are avoided by periodically and temporarily relieving pressure exerted by the chambers against different areas of the person. In one embodiment the cushion is generally toroidally shaped, with a generally T-shaped central opening, and in another embodiment the cushion has a shaped reduced thickness central portion.

U.S. Pat. No. 6,952,906 appears to disclose a chair which has a removable outer cover. The chair has an air permeable bladder which houses compressible filler material. The compressible filler material allows the chair to be selectively compressed between various compressed states. A method for packaging the chair is provided which significantly reduces the weight and size of the chair. The method includes placing the chair in a vacuum chamber and suctioning air from the chair. The vacuum chamber may be partially open or closed during storage.

U.S. Pat. No. 6,899,387 appears to disclose an entertaining cushion that the user can change the shape and visually enjoy such shape changes. The cushion includes an outer cover member formed by integrally combining a plurality of individual bag members that have different shapes such that the respective interiors of the bag members are in fluid communication with each other and a particulate filling material provided in the outer cover member that is capable of changing the appearance of the outer cover member by moving between and among the interiors of the bag members. Beads are used as the filling material.

U.S. Pat. Nos. 6,725,482 and 6,279,184 appear to disclose a substantially spherical frameless chair comprising an at least partially gas permeable outer liner, an at least partially gas permeable inner liner positioned inside of the outer liner, and a plurality of polyurethane foam pieces having a density between approximately 1.0 and approximately 3.0 pounds per cubic foot retained within the inner liner. The outer liner includes a first end component having a substantially circular peripheral geometry, a second end component having a substantially circular peripheral geometry, and an intermediate component having a substantially rectangular peripheral geometry wherein the first and second end components are secured to the intermediate component to, in turn, form a substantially spherical outer liner. The inner liner includes a first end component having a substantially circular peripheral geometry, a second end component having a substantially circular peripheral geometry, and an intermediate component having a substantially rectangular peripheral geometry, wherein the first and second end components are secured to the intermediate component to, in turn, form a substantially spherical inner liner.

U.S. Pat. No. 6,611,980 appears to disclose a custom-contoured cushion for a wheelchair or other seating device and a method of making the same. In one embodiment, the novel custom-contoured cushion is comprised of a stretchable bag filled with soft and resilient closed-cell foam pellets adhered together by and/or embedded within an elastomeric polymerizable adhesive. The pellets do not absorb a significant amount of the adhesive and, after molding, remain sufficiently soft and resilient to provide a comfortable and durable cushion. Alternatively, the cushion contains soft and resilient pellets, but does not contain the elastomeric polymerizable adhesive. In the first embodiment, the custom-molded, custom contoured cushion is made by mixing the pellets with the adhesive to form a pellet/adhesive mixture, positioning the user on a bag filled with the pellet/adhesive mixture, molding the mixture around the user to provide cushioning around the user's seating surface, and allowing the adhesive to cure. The pellets and adhesive may either be added to the bag separately and mixed within the bag, or may be mixed outside the bag, after which the pellet/adhesive mixture is added to the bag.

U.S. Pat. No. 6,141,807 appears to disclose an adjustable height pillow that offers a user the option of many heights and degrees of firmness, and which encourages proper posture in various meditation and other sitting positions. The pillow is comfortable for the user in either meditation or normal sitting environments including workstations. The pillow includes at least one encircling belt either within a concealing sleeve or exposed as a dramatic design statement. The belt can cinch and constrict the medial portion of the pillow by reducing its circumference, thereby causing the filler material to move from the medial portion to respective upper and lower portions of the pillow thus increasing the height of said pillow.

U.S. Pat. No. 3,965,506 appears to disclose an article of furniture which has a cover of a flexible material having strength generally only in tension which defines a closed cushion chamber therein filled with ground flakes of expanded plastic material mixed with shredded particles of foam rubber. The cover may be made of an elongate generally rectangular piece of flexible material folded back over itself midway its length with the opposed side edges of the material overlying each other seamed together and the overlying ends of the material attached together so that the opposed side seams overlie each other at the overlying ends to form a chair. The cover may also be made in the form of a generally rectilinear seat cushion with a front edge, a generally parallel rear edge and a pair of end edges connecting the front and rear edges, and an elongate bolster having a length approximately equal to the sum of the lengths of the rear edge and both ends of the seat cushion with the opposite ends of the bolster attached to the seat cushion at the opposite ends of the front edge so that the bolster forms the back and arms of a couch. The disclosure also contemplates the method of manufacture of the furniture.

United States Patent Application Publication Number 2003/0066268 appears to disclose a process for packaging a polyurethane foam filled article of furniture (e.g., a frameless chair), comprising the steps of: (a) providing a polyurethane foam filled article of furniture having an initial volume; (b) reducing the initial volume of the polyurethane foam filled article of furniture to a reduced volume, comprising at least one of the steps of: (1) decreasing air pressure within the polyurethane foam filled article of furniture via a vacuum source; and (2) compressing the initial volume of the polyurethane foam filled article of furniture to a reduced volume; and (c) associating the polyurethane foam filled article of furniture with a package.

While the above-identified patents and publications do appear to disclose furniture assemblies, their configurations remain non-desirous and/or problematic inasmuch as, among other things, none of the above-identified furniture assemblies appear to maintain a predetermined frameless furniture assembly configuration that resembles a framed furniture assembly as is disclosed herein—among other things.

It is therefore an object of the present invention to provide a frameless furniture assembly that comprises one or more configuration support members.

These and other objects of the present invention will become apparent in light of the present specification, claims, and drawings.

SUMMARY OF THE INVENTION

The present invention is directed to, in one embodiment, a frameless furniture assembly adapted to be converted between an unfilled configuration and a filled configuration, consisting of, consisting essentially of, and/or comprising: (a) an outer liner having an inner surface and an outer surface; (b) a plurality of pieces of fill material, wherein the fill material is retained within the outer liner; and (c) at least one configuration support member associated with the inner surface of the outer liner.

In a preferred embodiment of the present invention, the frameless furniture assembly comprises a chair adapted to support a human in a seated position.

In another preferred embodiment of the present invention, the frameless chair comprises a seat member.

In yet another preferred embodiment of the present invention, the frameless chair comprises a back support member.

In another aspect of the present invention, the frameless chair comprises a left side, a right side, a back side, and a front side.

In a preferred embodiment of the present invention, the frameless chair comprises a seat member, a back support member, a floor-engaging base member, a left side, a right side, a back side, and a front side.

In another preferred embodiment of the present invention, at least a portion of the floor-engaging base member is generally air permeable.

In yet another preferred embodiment of the present invention, at least a portion of the floor-engaging base member is generally air permeable and the remainder of the frameless chair is generally air impermeable.

In a preferred embodiment of the present invention, the outer liner comprises twenty-four swatches and twenty-five configuration support members.

In another preferred embodiment of the present invention, the floor-engaging base member comprises a zipper.

In yet another preferred embodiment of the present invention, the plurality of pieces of fill material comprise polystyrene.

In a preferred embodiment of the present invention, the seat member comprises two swatches, the back support member comprises eight swatches, the floor-engaging base member comprises four swatches, the left side, the right side, and the back side collectively comprise eight swatches, and the front side comprises two swatches.

In one aspect of the present invention, the seat member comprises an inner seam and an outer seam, the floor-engaging base member comprises an inner seam and an outer seam, and a first configuration support member, a second configuration support member, and a third configuration support member are secured to the inner seam of the seat member and the inner seam of the floor-engaging base member.

In one preferred embodiment of the present invention, a fourth configuration support member, a fifth configuration support member, a sixth configuration support member, a seventh configuration support member, an eighth configuration support member, a ninth configuration support member, and a tenth configuration support member are secured to the outer seam of the seat member and the outer seam of the floor-engaging base member.

In a preferred embodiment of the present invention, an eleventh configuration support member, a twelfth configuration support member, a thirteenth configuration support member, a fourteenth configuration support member, a fifteenth configuration support member, a sixteenth configuration support member, a seventeenth configuration support member, an eighteenth configuration support member, a nineteenth configuration support member, a twentieth configuration support member, a twenty-first configuration support member, a twenty-second configuration support member, a twenty-third configuration support member, a twenty-fourth configuration support member, and a twenty-fifth configuration support member are secured to the back support member and collectively to the left side, the back side, and the right side.

Preferably, the configuration support members of the present invention maintain the frameless furniture assembly in a predetermined configuration that resembles a framed furniture assembly.

The present invention is also directed to, in one embodiment, a frameless furniture assembly adapted to be converted between an unfilled configuration and a filled configuration, consisting of, consisting essentially of, and/or comprising: (a) an outer liner having an inner surface and an outer surface; (b) a plurality of pieces of fill material, wherein the plurality of pieces of fill material are retained within the outer liner, and wherein the plurality of pieces of fill material comprise polystyrene; (c) wherein the frameless furniture assembly comprises a seat member, a back support member, a floor-engaging base member, a left side, a right side, a back side, and a front side; (d) wherein the seat member comprises two swatches, wherein the back support member comprises eight swatches, wherein the floor-engaging base member comprises four swatches, wherein the left side, the right side, and the back side collectively comprise eight swatches, and wherein the front side comprises two swatches; (e) wherein the seat member comprises an inner seam and an outer seam, wherein the floor-engaging base member comprises an inner seam and an outer seam, wherein a first configuration support member, a second configuration support member, and a third configuration support member are secured to the inner seam of the seat member and the inner seam of the floor-engaging base member; (f) wherein a fourth configuration support member, a fifth configuration support member, a sixth configuration support member, a seventh configuration support member, an eighth configuration support member, a ninth configuration support member, and a tenth configuration support member are secured to the outer seam of the seat member and the outer seam of the floor-engaging base member; (g) wherein an eleventh configuration support member, a twelfth configuration support member, a thirteenth configuration support member, a fourteenth configuration support member, a fifteenth configuration support member, a sixteenth configuration support member, a seventeenth configuration support member, an eighteenth configuration support member, a nineteenth configuration support member, a twentieth configuration support member, a twenty-first configuration support member, a twenty-second configuration support member, a twenty-third configuration support member, a twenty-fourth configuration support member, and a twenty-fifth configuration support member are secured to the back support member and collectively to the left side, the back side, and the right side; (h) wherein the configuration support members maintain the frameless furniture assembly in a predetermined configuration that resembles a framed furniture assembly; (i) wherein at least a portion of the floor-engaging base member is generally air permeable and the remainder of the frameless chair is generally air impermeable, and wherein the floor-engaging base member comprises a zipper; and (j) wherein the frameless furniture assembly comprises a chair adapted to support a human in a seated position.

The present invention is further directed to, in one embodiment, a frameless furniture assembly adapted to be converted between an unfilled configuration and a filled configuration, consisting of, consisting essentially of, and/or comprising: (a) an outer liner having an inner surface and an outer surface; (b) a plurality of pieces of fill material, wherein the plurality of pieces of fill material are retained within the outer liner; (c) wherein the frameless furniture assembly comprises a seat member, a back support member, a floor-engaging base member, a left side, a right side, a back side, and a front side; (d) a plurality of configuration support members, wherein the configuration of support members maintain the frameless furniture assembly in a predetermined configuration that resembles a framed furniture assembly; (e) wherein at least a portion of the floor-engaging base member is generally air permeable and wherein the floor-engaging base member comprises a zipper; and (f) wherein the frameless furniture assembly comprises a chair adapted to support a human in a seated position.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
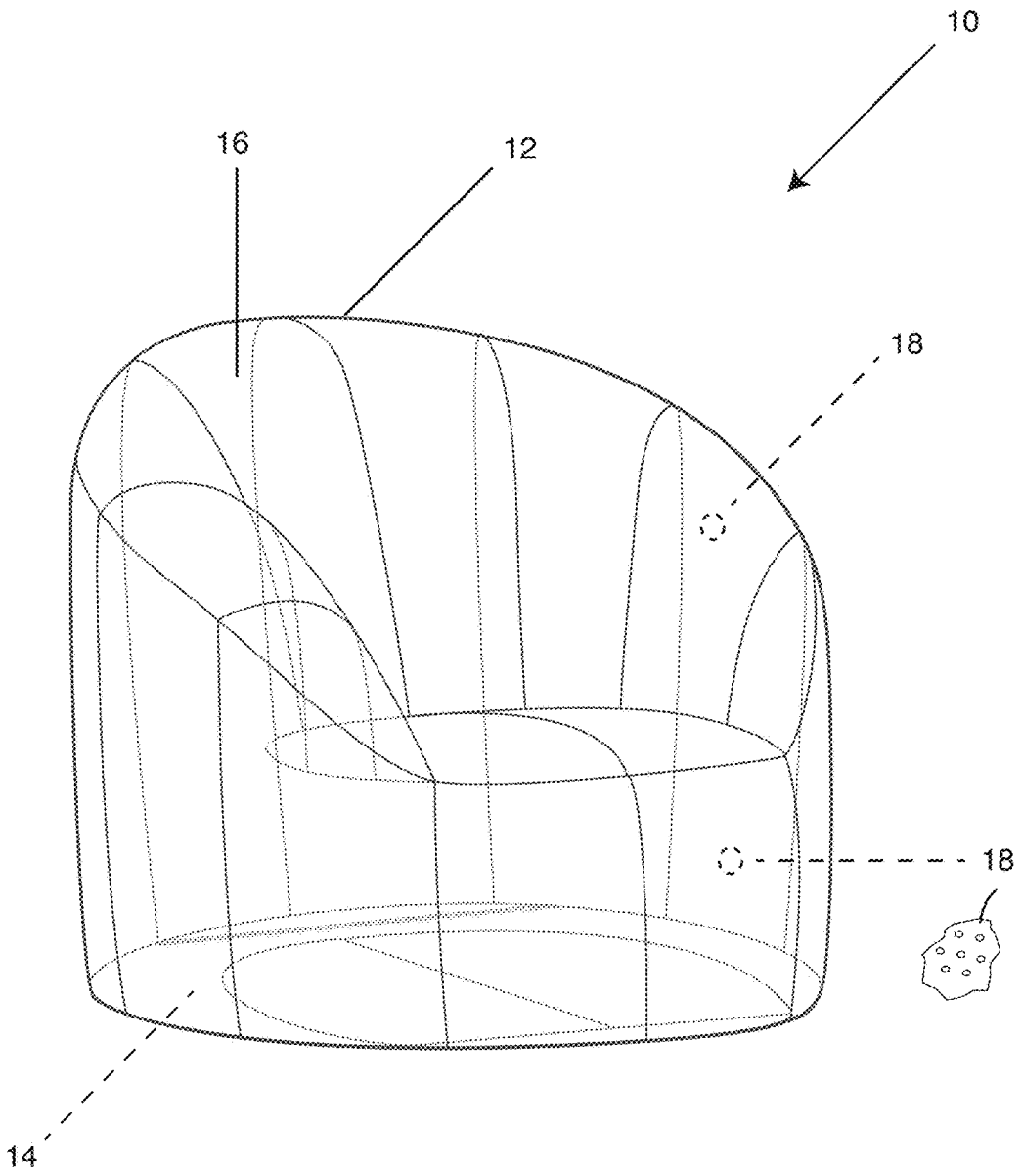
FIG. 1 of the drawings is a transparent isometric view illustrating the front right portion of a frameless furniture assembly in accordance with the present invention.
Figure 2:
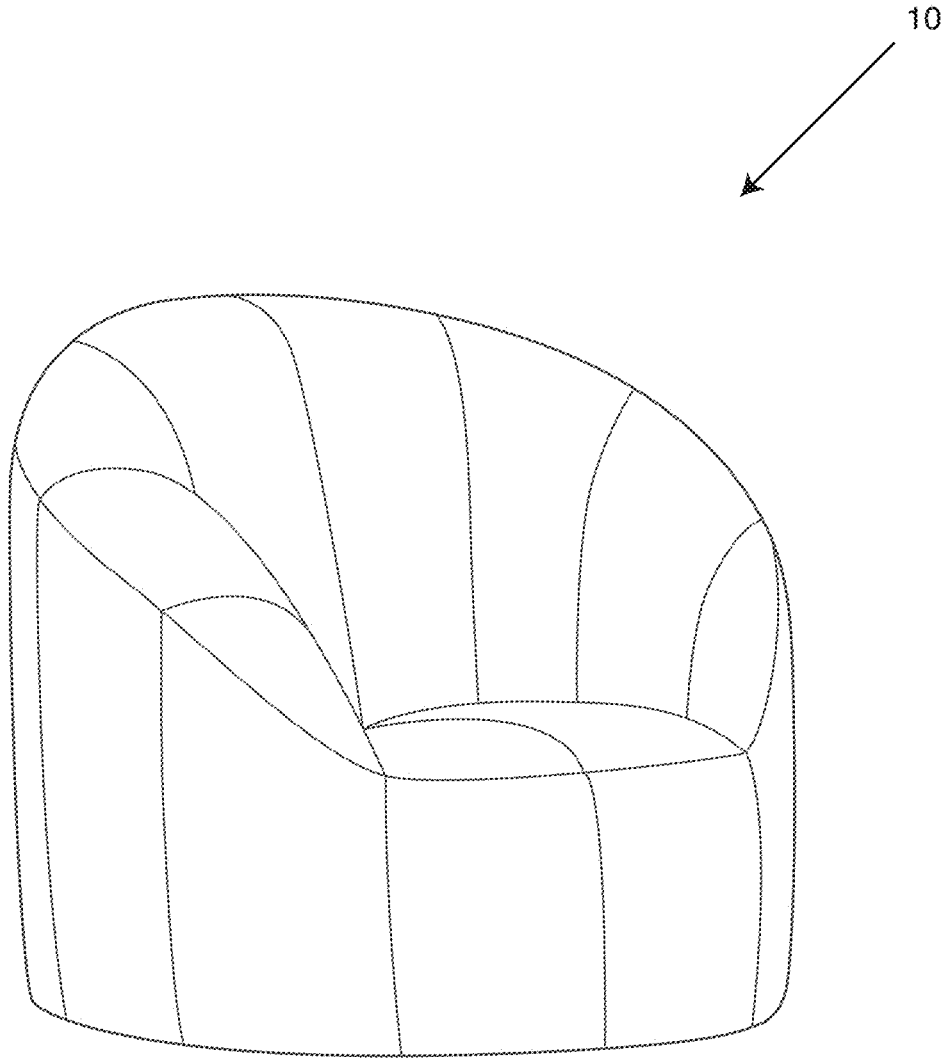
FIG. 2 of the drawings is an isometric view illustrating the front right portion of a frameless furniture assembly in accordance with the present invention.

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1 and 11 in particular, frameless furniture assembly 10 (e.g., a chair adapted to support a human in a seated position) is shown which generally comprises outer liner 12 having inner surface 14 and outer surface 16, a plurality of fill material 18 (e.g., polyurethane, polystyrene, etcetera) retained within outer liner 12, and one or more configuration support members 20 (e.g., 20.1-20.25) that, as will be discussed in greater detail infra, maintain frameless furniture assembly 10 in a predetermined configuration that resembles a framed furniture assembly.

Figure 3:
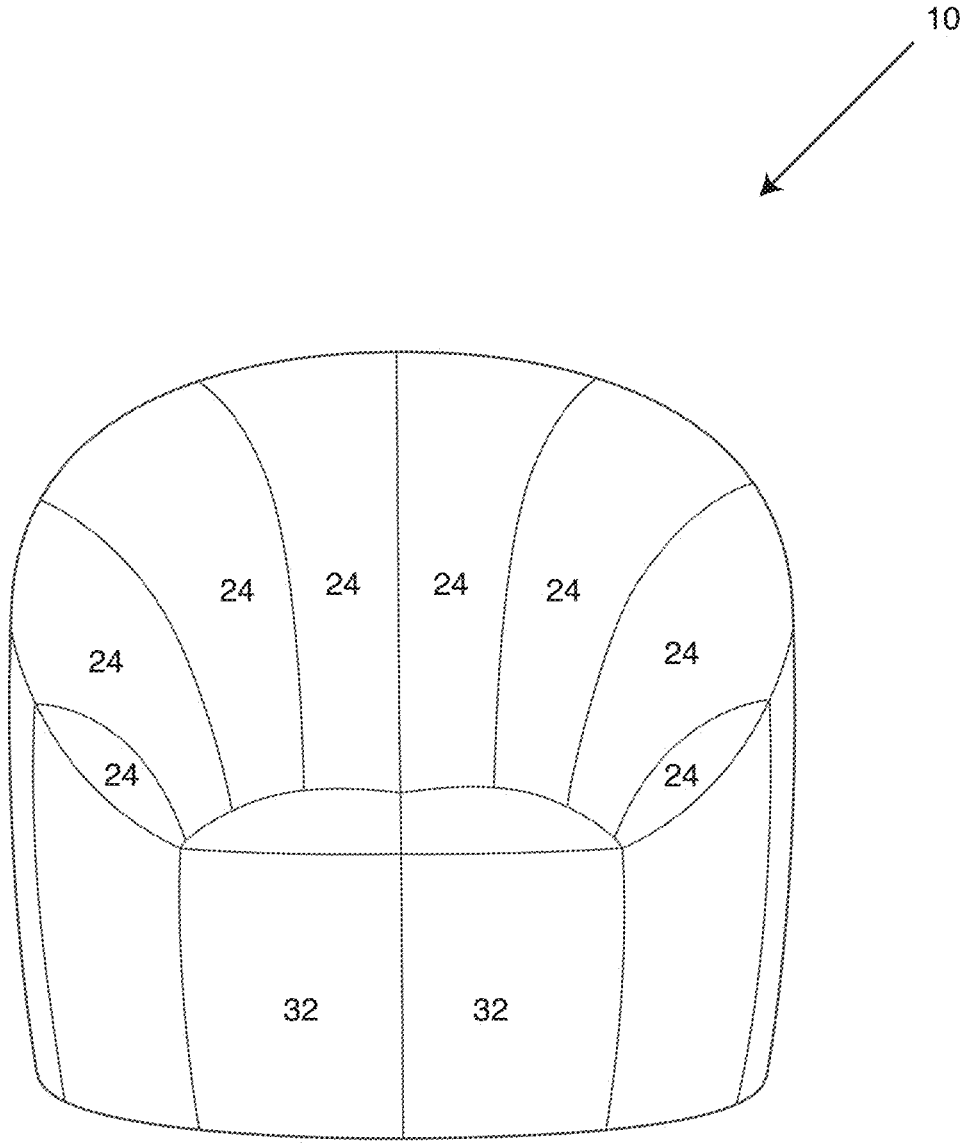
FIG. 3 of the drawings is a front view of a frameless furniture assembly in accordance with the present invention.
Figure 4:
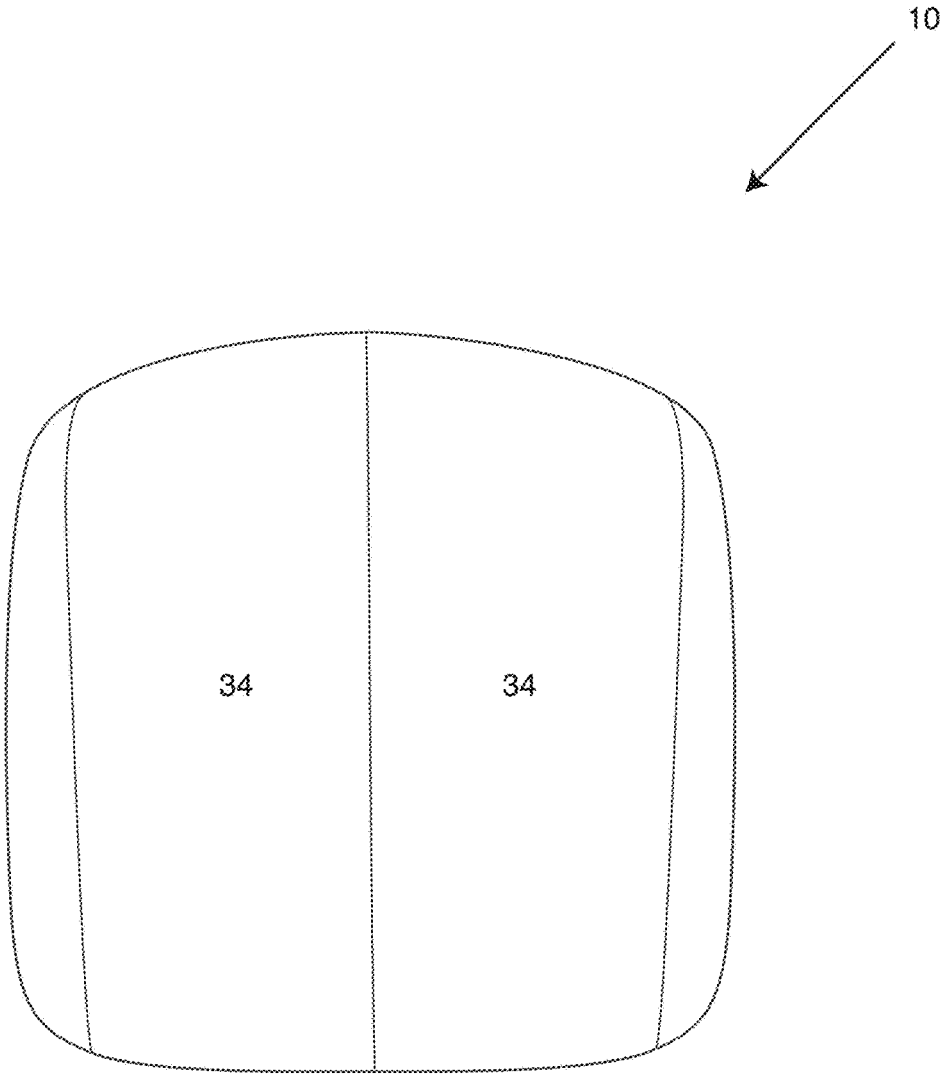
FIG. 4 of the drawings is a back view of a frameless furniture assembly in accordance with the present invention.
Figure 5:
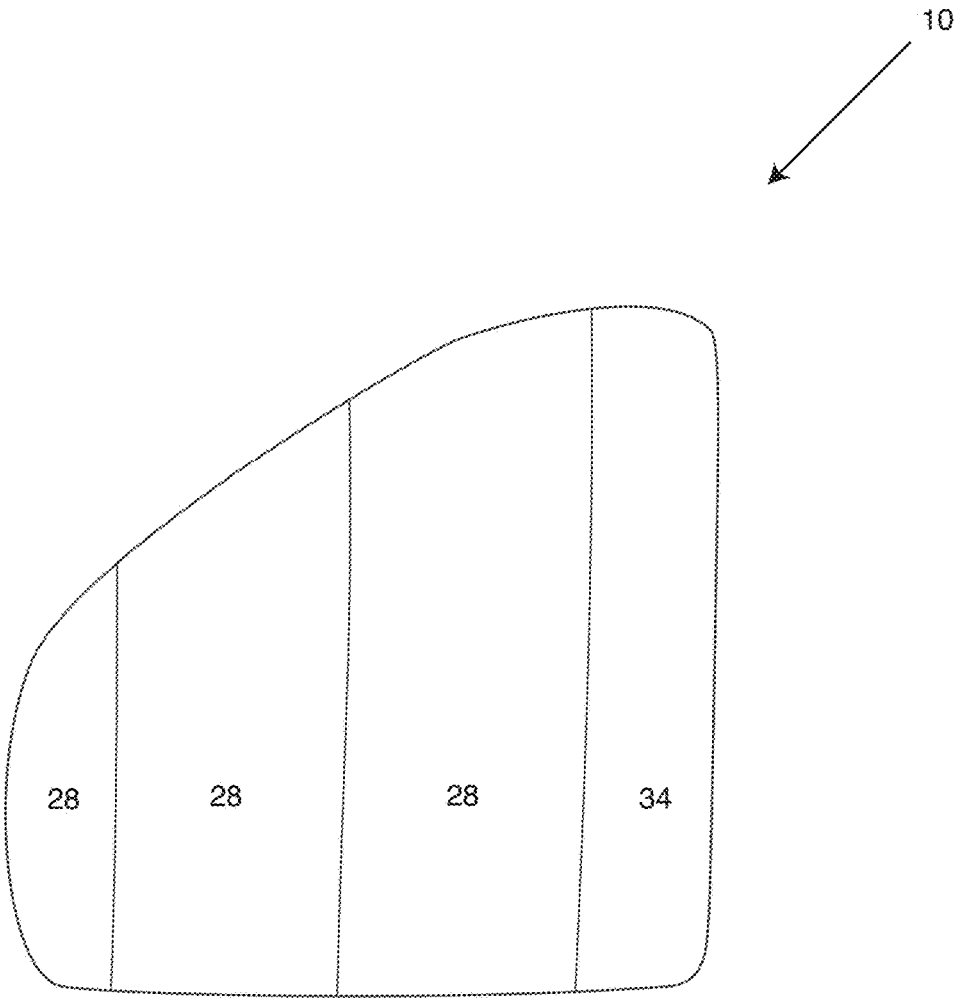
FIG. 5 of the drawings is a left side elevation of a frameless furniture assembly in accordance with the present invention.
Figure 6:
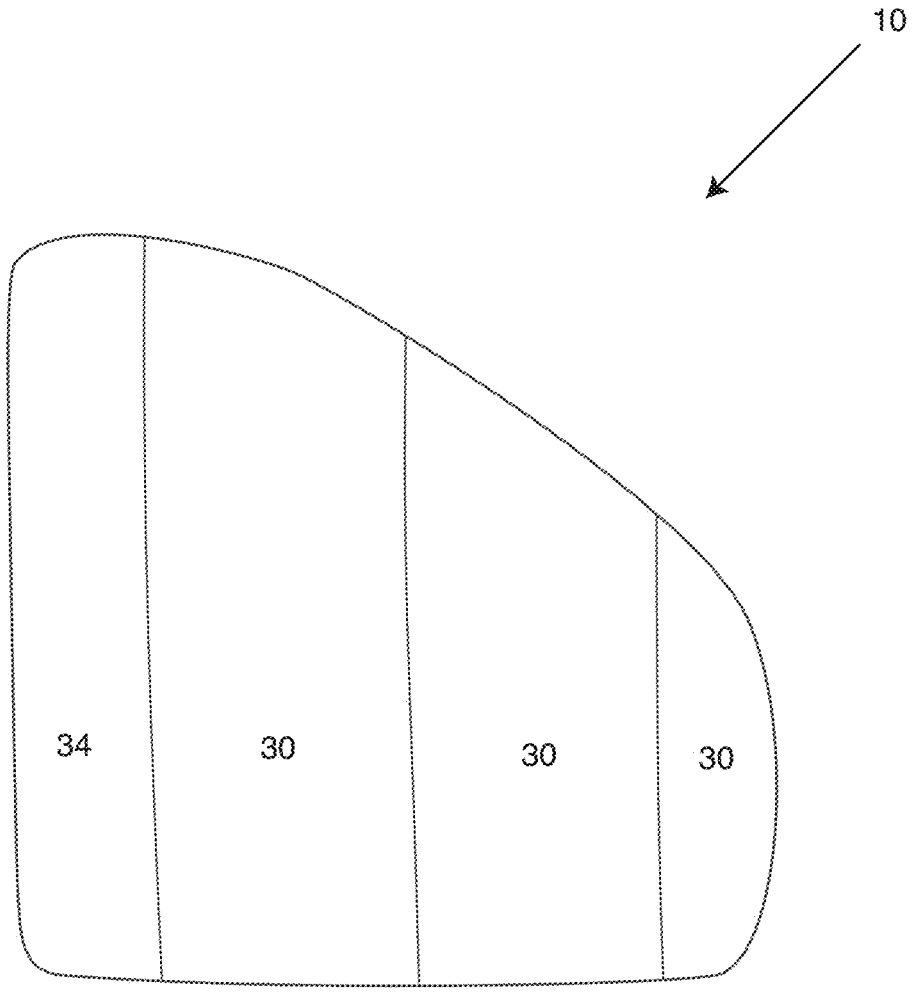
FIG. 6 of the drawings is a right side elevation of a frameless furniture assembly in accordance with the present invention.
Figure 7:
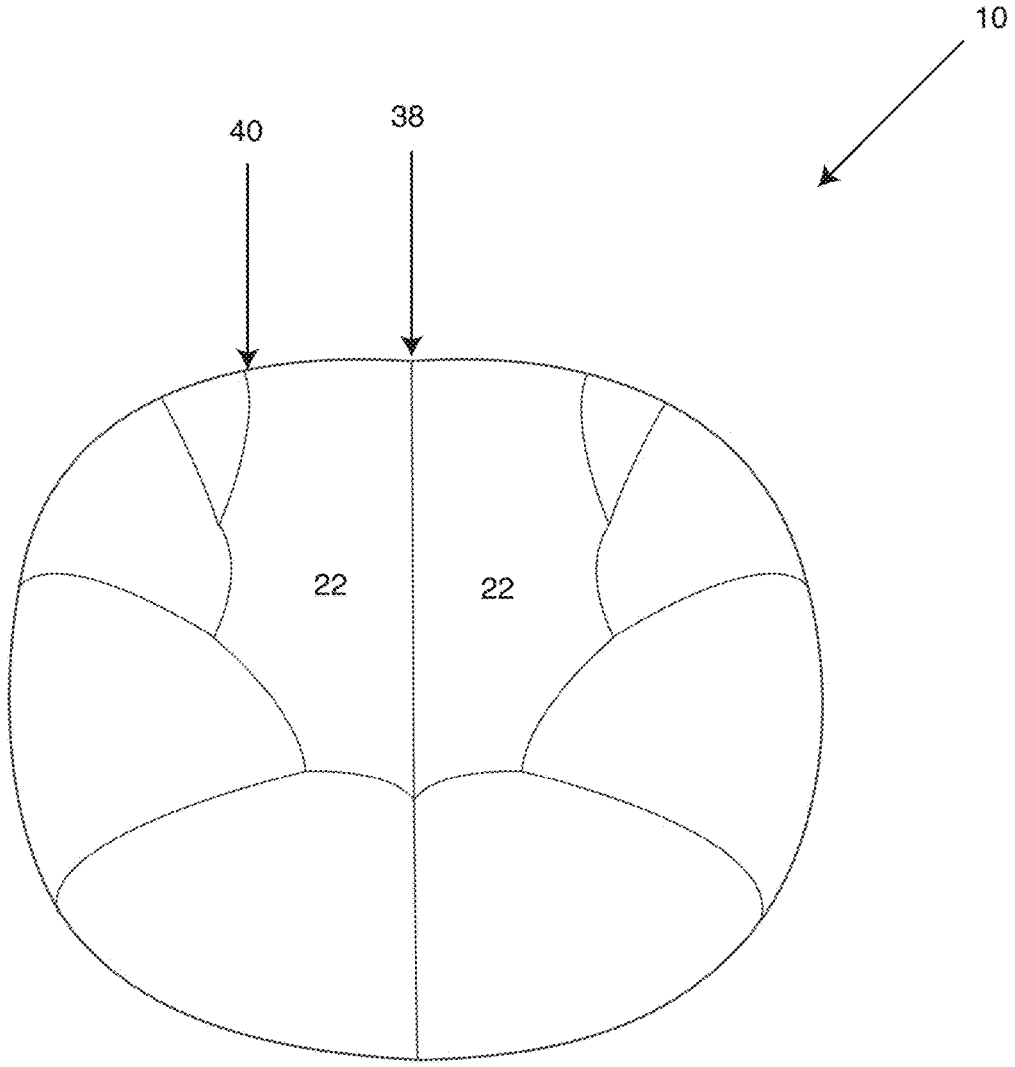
FIG. 7 of the drawings is a top view of a frameless furniture assembly in accordance with the present invention.

In one embodiment of the present invention, and as is best shown collectively in FIGS. 1-11, when frameless furniture assembly 10 is generally filled with fill material 18, frameless furniture assembly 10 generally comprises seat member 22 (FIG. 7), back support member 24 (FIG. 3), floor-engaging base member 26 (FIG. 8), left side 28 (FIG. 5), right side 30 (FIG. 6), front side 32 (FIG. 3), and back side 34 (FIG. 4). It will be understood that one or more of the above-identified sub-components may be omitted from frameless furniture assembly 10 so long as it remains adapted to support a human in a seated position.

Figure 8:
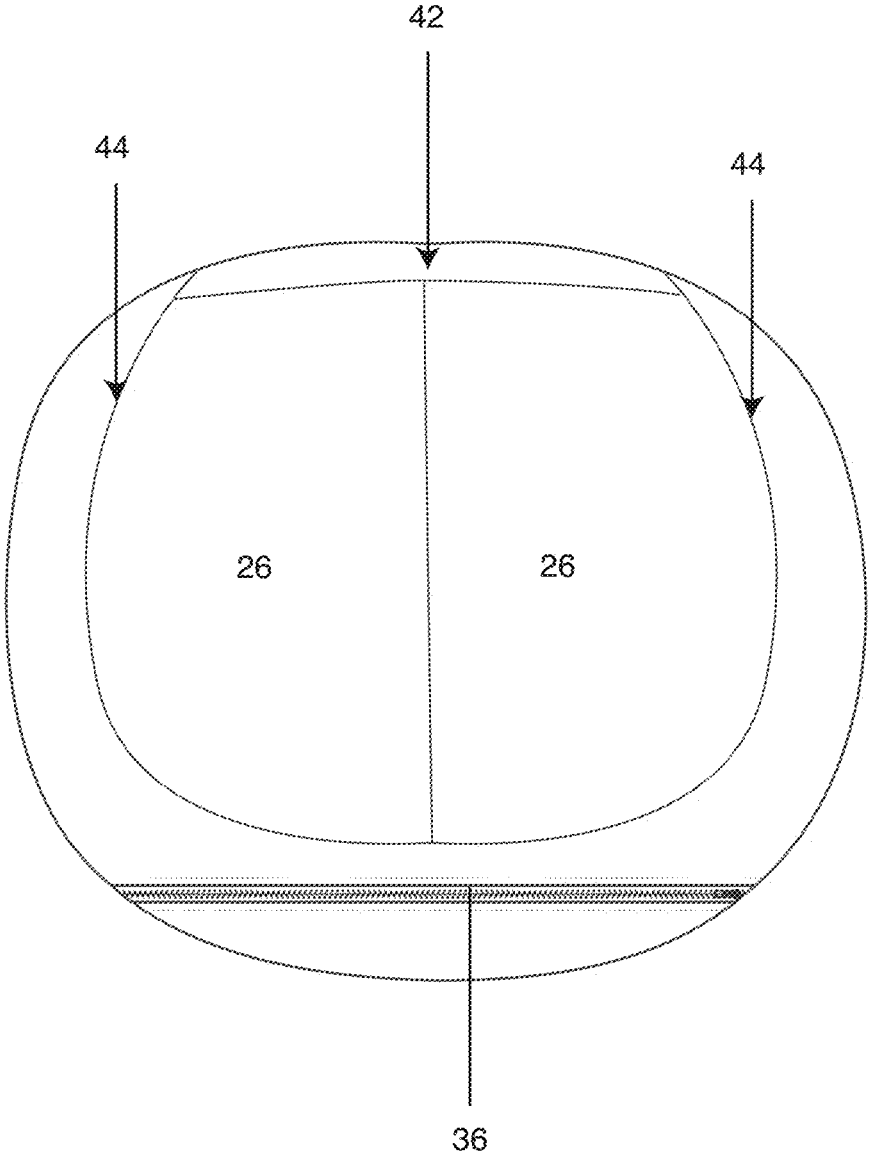
FIG. 8 of the drawings is a bottom view of a frameless furniture assembly in accordance with the present invention.

As is best shown in FIG. 8, at least a portion of floor-engaging base member 26 is generally air and/or moisture permeable. Such air permeability facilitates rapid filling of frameless furniture assembly 10 during free-flow and/or pressurized fills. Additionally, the moisture permeability allows frameless furniture assembly 10 to reduce and/or eliminate undesirable growth of, for example, bacteria, spores, mold, mildew, etcetera. In one embodiment, the remainder of frameless furniture assembly 10 is substantially (+/−10%) and/or generally air and/or moisture impermeable.

Referring once again to FIG. 8, floor-engaging base member 26 includes zipper 36. Zipper 36 may include a single or double zipper.

In a preferred embodiment of the present invention, the plurality of pieces of fill material 18 comprise polystyrene. However, it will be understood that the fill material may also comprise polyurethane, natural and/or synthetic materials, and/or fibers.

Referring once again to FIGS. 1-11 and as is highlighted via transparent representation in FIG. 1, outer liner 12 preferably comprises twenty-four swatches which are fastened together proximate their peripheral geometries. Preferably, the swatches of outer liner 12 are stitched together via single-needle lock stitch and/or double-needle top stitch. In this embodiment, seat member 22 preferably comprises two swatches (FIG. 7), back support member 24 preferably comprises eight swatches (FIG. 3), floor-engaging base member 26 comprises four swatches (FIG. 8), and left side 28, right side 30, and back side 34 collectively preferably comprise eight swatches (FIGS. 4-6), and front side 32 preferably comprises two swatches (FIG. 3).

Referring once again to FIGS. 1-11 and as is highlighted via transparent representation in FIG. 11, frameless furniture assembly 10 comprises one or more configuration support members 20 that maintain frameless furniture assembly 10 in a predetermined configuration that resembles a framed furniture assembly. Notably, back support member 24, left side 28, right side 30, and back side 34 remain upright and formed—even though frameless furniture assembly 10 is free from any rigid frame sub-assembly.

Figure 9:
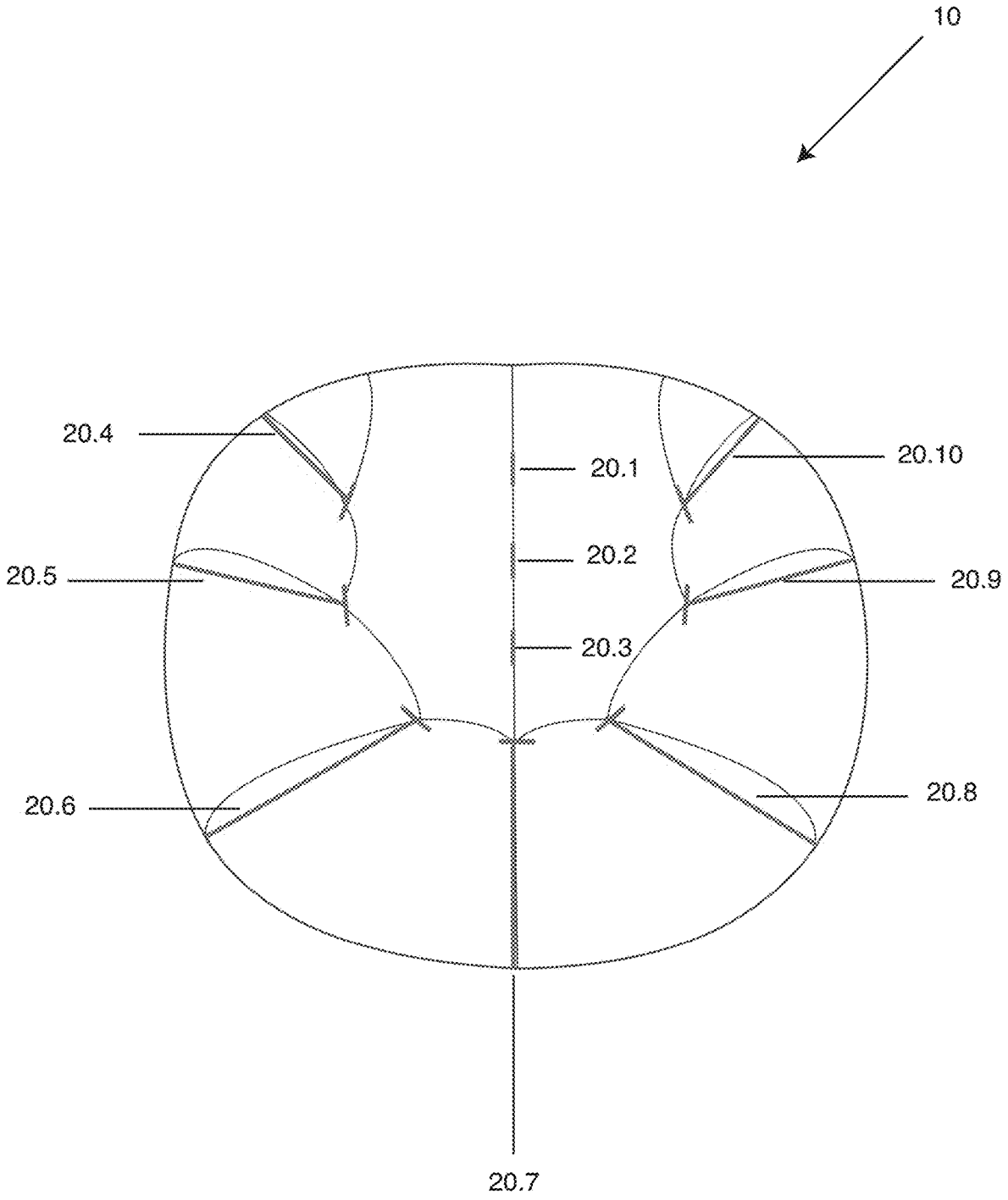
FIG. 9 of the drawings is a top view of a frameless furniture assembly in accordance with the present invention illustrating a plurality of configuration support members.
Figure 10:
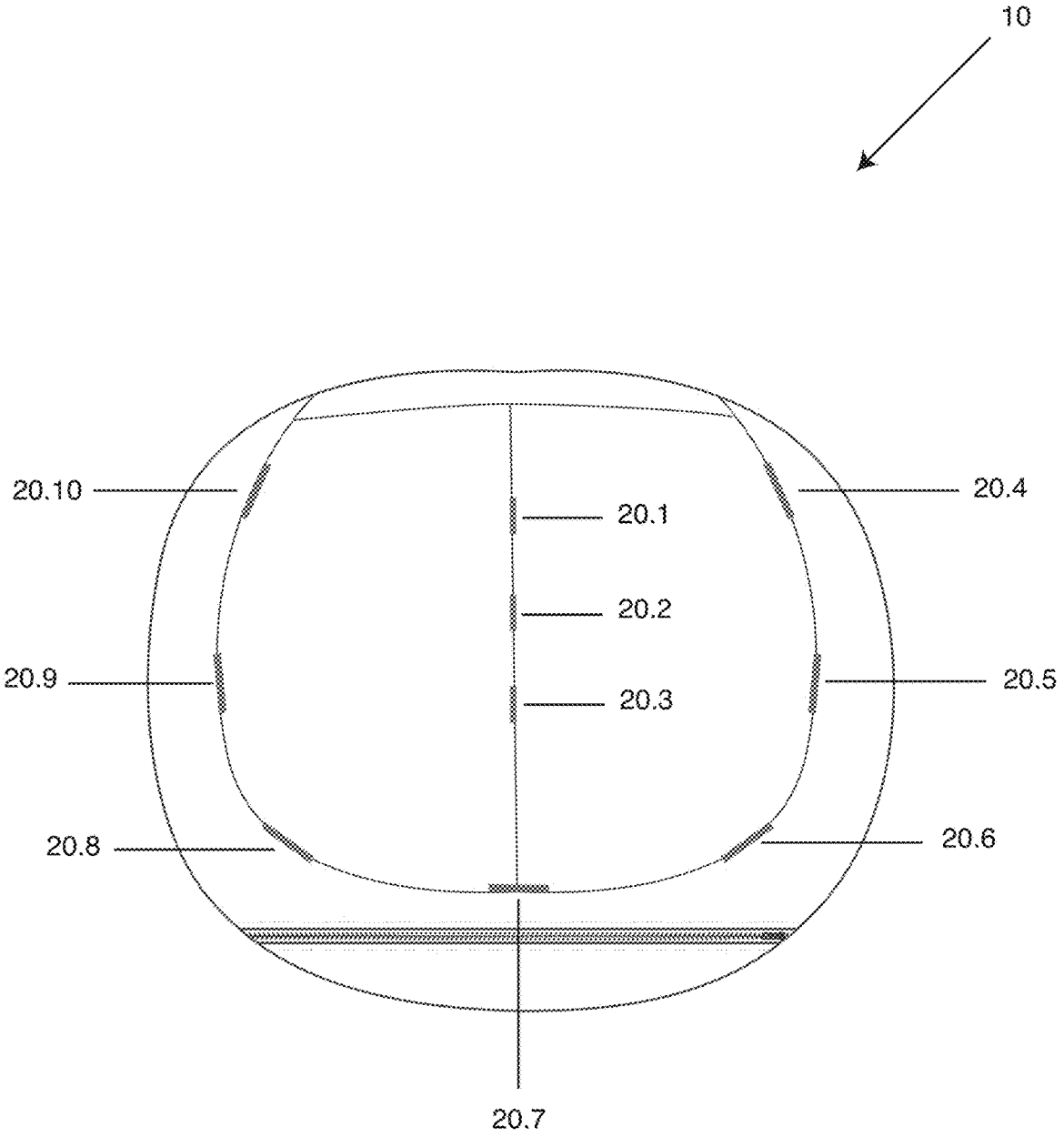
FIG. 10 of the drawings is a bottom view of a frameless furniture assembly in accordance with the present invention illustrating a plurality of configuration support members.
Figure 11:
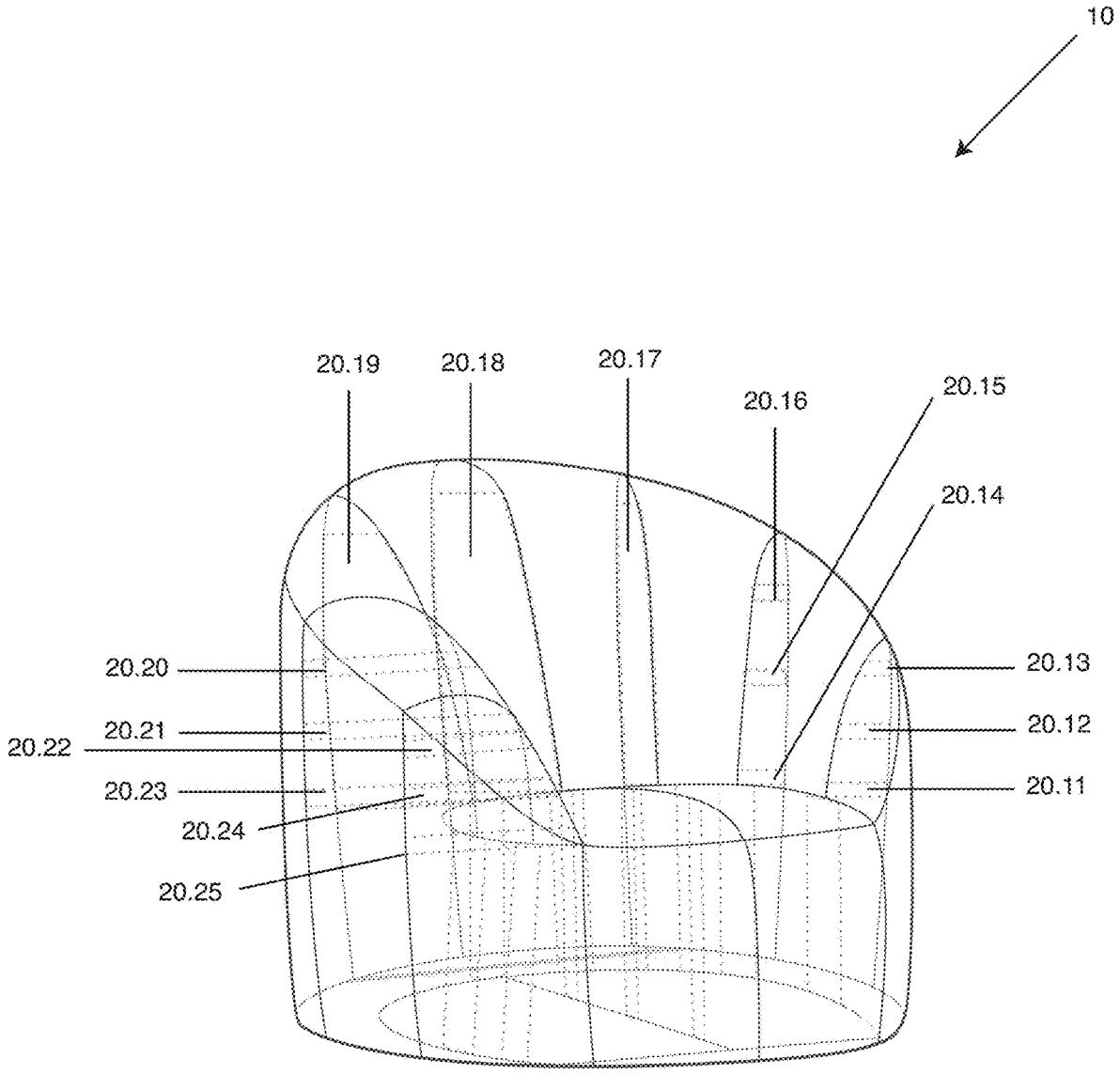
FIG. 11 of the drawings is a transparent isometric view a frameless furniture assembly in accordance with the present invention illustrating a plurality of configuration support members.

In a preferred embodiment of the present invention, and as is best shown in FIGS. 9-11, frameless furniture assembly 10 preferably includes twenty-five configuration support members, namely: 20.1-20.25.

In one embodiment of the present invention, seat member 22 comprises inner seam 38 and outer seam 40, and floor-engaging base member 26 comprises inner seam 42 and outer seam 44, wherein first configuration support member 20.1, second configuration support member 20.2, and third configuration support member 20.3 are secured to inner seam 38 of seat member 22 and inner seam 42 of floor-engaging base member 26.

In another aspect of the present invention, fourth configuration support member 20.4, fifth configuration support member 20.5, sixth configuration support member 20.6, seventh configuration support member 20.7, eighth configuration support member 20.8, ninth configuration support member 20.9, and tenth configuration support member 20.10 are secured to outer seam 40 of seat member 22 and outer seam 44 of floor-engaging base member 26.

In yet another aspect of the present invention, eleventh configuration support member 20.11, twelfth configuration support member 20.12, thirteenth configuration support member 20.13, fourteenth configuration support member 20.14, fifteenth configuration support member 20.15, sixteenth configuration support member 20.16, seventeenth configuration support member 20.17, eighteenth configuration support member 20.18, nineteenth configuration support member 20.19, twentieth configuration support member 20.20, twenty-first configuration support member 20.21, twenty-second configuration support member 20.22, twenty-third configuration support member 20.23, twenty-fourth configuration support member 20.24, and twenty-fifth configuration support member 20.25 are secured to back support member 24 and collectively to left side 28, right side 30 and back side 34.

Configuration support members 20 preferably comprise a flexible natural and/or synthetic material or fabric that is bendable in two-axes, but not extendible in a third axis—such as the length or longitudinal axis of the material or fabric.

Configuration support members 20 are preferably secured to sub-components of outer liner 12 via stitching, adhesive, threaded fasteners, non-threaded fasteners, rivets, etcetera.

In a preferred embodiment of the present invention, the outer liner and the optional inner liner may comprise breathable or non-breathable fabrics such as cotton, denim, wool, and/or any one of a number of synthetic fabrics—just to name a few.

In accordance with the present invention, frameless furniture assembly 10 may optionally include an accessory pocket (not shown). Such an accessory pocket is preferably adapted to retain, for example, a remote control, earphones, headphones, as well as other electronic and non-electronic accessories.

In further accordance with the present invention, frameless furniture assembly 10 may optionally include a handle member (not shown) which is preferably positioned proximate the top portion of back support member 24.

Frameless furniture assembly 10 may also include an optional inner liner as is disclosed in U.S. Pat. No. 6,725,482 entitled "Frameless Chair," and U.S. Pat. No. 6,279,184 entitled "Frameless Chair."

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A frameless furniture assembly adapted to be converted between an unfilled configuration and a filled configuration, comprising:

an outer liner having an inner surface and an outer surface;

a plurality of pieces of fill material, wherein the plurality of pieces of fill material are retained within the outer liner;

wherein the frameless furniture assembly comprises a seat member, a back support member, a floor-engaging base member, a left side, a right side, a back side, and a front side;

a plurality of configuration support members, wherein the plurality of configuration support members maintain the frameless furniture assembly in a predetermined configuration that resembles a framed furniture assembly, and wherein the plurality of configuration support members comprise at least two configuration support members that are secured to the floor-engaging base member and the seat member and at least three additional configuration support members that are secured to the back support member and the left side, the right side and the back side, respectively;

wherein the floor-engaging base member comprises a zipper; and wherein the frameless furniture assembly comprises a chair adapted to support a human in a seated position.

2. The frameless furniture assembly according to claim 1, wherein the outer liner consists of twenty-four swatches.

3. The frameless furniture assembly according to claim 2, comprising twenty-five configuration support members.

4. The frameless furniture assembly according to claim 2 wherein the plurality of pieces of fill material comprise polystyrene.

* * * * *